United States Patent [19]

Karrer et al.

[11] 4,075,765

[45] * Feb. 28, 1978

[54] PROCESS AND DEVICE FOR DRYING FIBROUS MATERIAL

[75] Inventors: Friedrich Wilhelm Johann Karrer, Stockholm, Sweden; Per Gustaf Mellgren, Montreal, Canada

[73] Assignee: Karrer System AG, Zurich, Switzerland

[ * ] Notice: The portion of the term of this patent subsequent to Dec. 23, 1992, has been disclaimed.

[21] Appl. No.: 640,390

[22] Filed: Dec. 12, 1975

[30] Foreign Application Priority Data

Dec. 16, 1974 Switzerland ..... 16667/74

[51] Int. Cl.[2] ..... F26B 3/00

[52] U.S. Cl. ..... 34/20; 34/21; 34/77; 34/104; 34/212

[58] Field of Search ..... 34/21, 104, 210, 212, 34/215, 77, 103, 191, 78

[56] References Cited

U.S. PATENT DOCUMENTS

| | | | |
|---|---|---|---|
| 1,997,380 | 4/1935 | Hornbuckle | 34/21 |
| 2,223,588 | 12/1940 | Watson | 34/21 |
| 2,739,392 | 3/1956 | Thies | 34/21 X |
| 3,631,691 | 1/1972 | Karrer | 34/104 X |
| 3,927,478 | 12/1975 | Karrer et al. | 34/104 X |

*Primary Examiner*—Alan Cohan
*Attorney, Agent, or Firm*—Stevens, Davis, Miller & Mosher

[57] ABSTRACT

A method and apparatus for drying separate units of moist fibrous material. The method may include the steps of flowing under a pressure greater than one atmosphere in a closed circuit a gaseous medium through both units of material, such that the gaseous exhaust from one unit is the gaseous intake of another unit, and heating the gaseous medium subsequent to its passage through the units of fibrous material by compressing the gaseous medium. The apparatus may include two containers each of which has a support for the fibrous material to be dried, the material being positioned on the support to divide the interior of each of said containers into an inner and an outer chamber which communicate with each other via the material, and a circulation system having a gaseous drying medium therein. The system includes the containers and comprises a first connection line for fluidly interconnecting the two inner chambers, a second connection line for fluidly interconnecting the two outer chambers, a first device for heating the gaseous drying medium in the first connection, a second device for heating the gaseous drying medium in the second connection line, and a water separator. One of the two devices is a compressor, the suction end of which is connected to the water separator.

7 Claims, 1 Drawing Figure

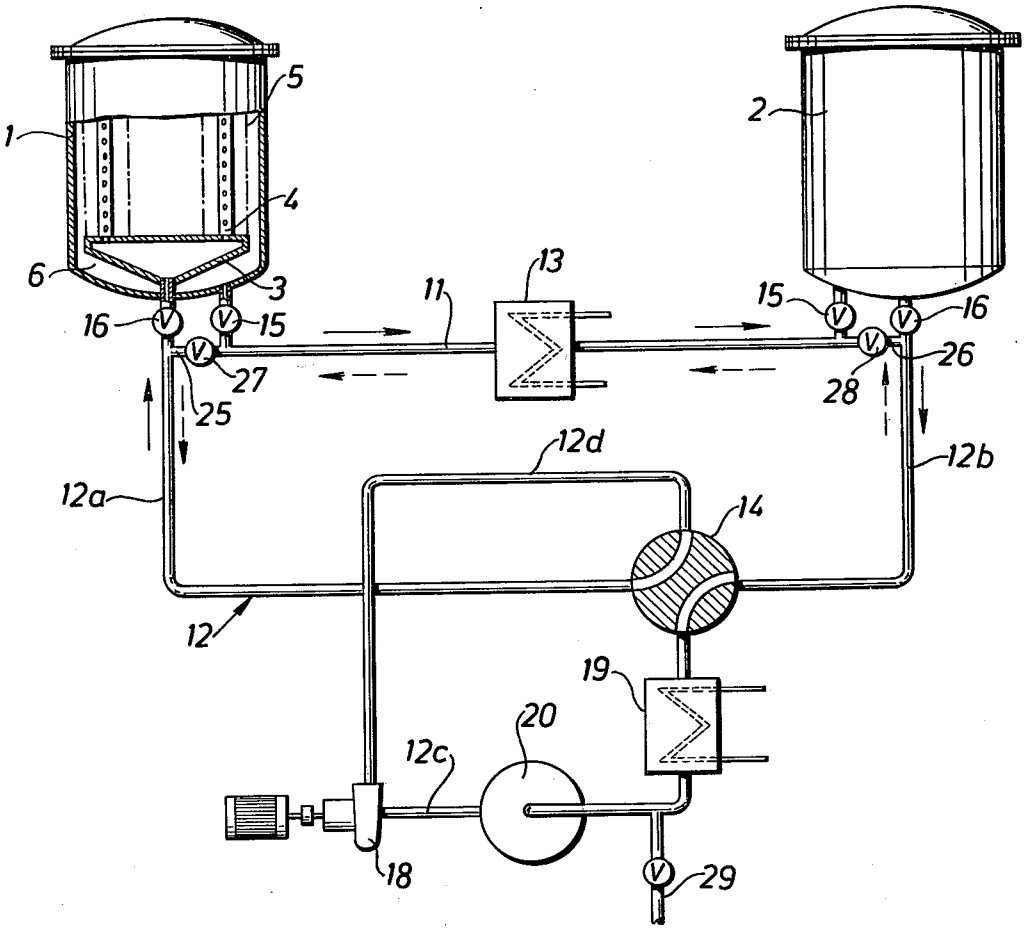
1
2
3
4
5
6
11
12
12a
12b
12c
12d
13
14
15
16
18
19
20
25
26
27
28
29

PROCESS AND DEVICE FOR DRYING FIBROUS MATERIAL

The present invention relates to a process and a device for drying fibrous material, in particular in the form of reels of yarn, in which said material is arranged in the flow path of a drying medium inside a container comprising two chambers, wherein the drying medium flows, in turn, through the fibrous material fillings of a plurality of containers arranged in a closed cycle and is heated each time before it passes through a fibrous material filling.

In a known process of this type, the gaseous drying medium, e.g. air, is conveyed through the fibrous material fillings with the aid of a vacuum pump. Although the series connection of two containers and the resultant extension of the path of the drying medium through the fibrous material produces an improved exploitation of the heat content of the drying medium, and in fact, by repeatedly reversing the direction of flow of the drying medium through the containers, it is also possible to attain a more uniform distribution of the moisture in the two fibrous material fillings, nevertheless the drying times are relatively long. As is known, in the case of large reels of non-uniform density, the progress of the drying process varies considerably, and in fact in particular during the final stage of the drying process. As the moisture content reduces in the less dense layers, these are increasingly traversed by the flow, and indeed, bypassing the denser and more moist zones or layers of the reels. Accordingly the drying medium absorbs increasingly less moisture. The reversal of the direction of flow of the drying medium through the chambers and thus through the fibrous material which is to be dried, provides only a partial improvement in this respect.

Nevertheless there is a constant reduction in the effectiveness of the drying process as time advances.

The purpose of the present invention is to provide a process in which the effectiveness of the drying process can be maintained at a relatively high level for the entire duration of the drying process. The invention is to realize the aim of avoiding marked differences in the moisture content of the layers of the fibrous material which is to be dried by means of as uniform as possible penetration of said material. In accordance with the invention, this aim is realized in that the drying medium is caused to flow through the fibrous material fillings at an excess pressure, and the drying medium is supplied with heat in that it is subjected to compression.

In accordance with a particularly advantageous embodiment of the process, when, for example fibrous material which is already relatively dry is being treated, a container containing a still relatively wet fibrous material filling can be included into the same cycle. Although the duration of the drying processes is basically the same in all the containers and for all the fibrous material fillings, the beginning and end of the drying processes for the individual material fillings are staggered. If, for example, two containers and two fibrous material fillings, simultaneously traversed by flow, are to be used, then in this case the drying commences only in one of the containers, i.e. only with one fibrous material filling. After a predetermined length of time, e.g. after half the length of the drying process, or when a specific state of dryness has been reached, e.g. a 50% reduction in moisture content, the fibrous material filling in the second container is also brought into the cycle and is traversed by the drying medium. Accordingly, the drying medium will meet with not only relatively dry fibrous material, but also with relatively wet fibrous material in the cycle and will thus be able to expel moisture with relatively slight fluctuations during the entire length of the drying process of a fibrous material filling. This measure, and likewise the compression of the drying medium, allows the drying time to be reduced. The uniform moisture content of the drying medium prevents a part of the yarn layers from over-drying, which leads to a careful treatment of the goods to be dried.

The invention also relates to a device for the execution of the process in accordance with the invention. Commencing from a device comprising two containers arranged in a cycle, and provided with carriers for the fibrous material which is to be dried which latter in each container, connects an inner chamber and an outer chamber to one another so as to allow the penetration of the flow, where the two inner chambers and the two outer chambers are each interconnected by a connection line, each of which contains means for heating the gaseous drying medium circulating in the cycle, the device in accordance with the invention is characterized in that as heating means, a compressor is connected into the one connection line, the suction end of said compressor being connected to a water separator.

In order to simplify the execution of the process in accordance with the invention and to avoid the drying process being interrupted on the insertion or the exchange of the fibrous material filling in one of the containers, for each container the connection lines contain a pair of shut-off valves and a by-pass component provided with a shut-off device. By closing the shut-off valves and releasing the by-pass component it is possible to take out of operation the container in which the fibrous material filling is to be exchanged, whilst the drying process continues in the other container.

In the following an exemplary embodiment of the process of the invention will be described in association with the explanation of an exemplary embodiment of the device which is represented in the drawing.

In the illustrated exemplary embodiment, the device for drying fibrous material possesses two identical containers which are referenced 1 and 2, the construction of which can be seen from the container 1, which is shown in section.

An inner chamber arranged in the lower part of the container is referenced 3, and on its upper side bears a plurality of upright, perforated pipes 4, the interiors of which are connected to the chamber 3. The pipes 4 form carriers for the fibrous material filling of the container, which in the illustrated exemplary embodiment is formed by cross-reels 5. The cross-reels 5 extend over the pipes 4 in the outer container chamber which is referenced 6 and are connected to the inner chamber 3 merely via the fibrous material of the yarn reels.

The two outer chambers 6 are connected to one another via a connection line 11 which contains an air heater referenced 13. The two inner chambers 3 of the containers 1 and 2 are connected to a four-way valve 14 via portions referenced **12*a* and 12*b* of another connection line. A further line portion 12*c*, which contains a condenser 19 and a water separator 20, serves to connect the four-way valve to a compressor 18. The pressure side of the compressor 18 is connected via a line portion 12*d* to the four-way valve 14. Each of the two connection lines 11 and 12 contains shut-off valves 15, 16 which are arranged adjacent to the containers 1** and 2, and by-pass lines 25 and 26 each of which can themselves be shut-off by valves 27, 28.

In dependence upon the position of the valve 14, the compressor 18 is either connected via the line 12*a* to the inner chamber 3 of the container 1, or is connected via the line 12*b* to the inner chamber of the container 2, whilst the direction of flow of the drying medium changes correspondingly in the line 11. The cross-reels 5 in the two containers 1 and 2 can thus alternately be traversed from the interior towards the exterior or from the exterior towards the interior.

The drying medium, e.g. air, is compressed by the compressor 18 to a pressure of 5 atm. The drying medium thereby becomes heated and accordingly is able to vaporize and expel moisture when it passes through the wet reels of yarn in the containers 1, 2. In order to replace, in the drying medium, at least a part of the heat discharged to the yarn reels in the container, the drying medium is conducted through the air heater 13 before it enters the container 2.

In order that the drying medium is able to vaporize and discharge moisture to a degree coresponding to its temperature and pressure for the entire duration of the drying process, the drying process is started and terminated in the containers 1 and 2 at different times. To this end the device can be set in operation when e.g. the container 1 has received its fibrous material filling in the form of wet cross-reels. On the other hand, as the container 2 e.g. is still empty, the latter's valves 15 and 16 are closed, whereas the valve 28 in the by-pass line 26 is open.

During this phase, the air heater is also not yet in operation and the drying medium, having emerged from the container 1, passes via the distributor line 11 and via the line portion 12*b* and valve 14 directly to the condensor 19.

When the drying in the container 1 has been in progress for a specific length of time, on account of the increasing dryness of the cross-reels 5, the moisture absorption of the drying medium also recedes.

Now the valves 15 and 16 are opened in the container 2, which has meanwhile been filled with wet cross-reels 5, and at the same time the valve 28 is closed. Simultaneously the air heater 13 is set in operation, The drying medium, which is now emerging from the container with an increasingly smaller moisture content, now flows through the cross-reels 5 which are arranged in the container 2. As a relatively large amount of moisture can be absorbed from these wet cross-reels, the drying medium can be exploited to its full capacity.

When the drying of the cross-reels in the container 1 has reached the necessary level, this container can be shorted in that the valve 27 is opened and the associated valves 16 and 15 are closed. Maintaining the drying process in the container 2, the dried reels can be withdrawn from the container 1 and the latter can be refilled with wet cross-reels. At this point it can be expedient to provide that before the drying process is started in the container 1, the valve 14 is switched over so that the container 2 is connected to the compressor whereas the container 1 is connected to the condenser.

In order to heat the fibrous material filling in the containers more rapidly, e.g. at the commencement of the drying process, it can be expedient to supply the containers with vapour from a suitable source. Suitable supply lines provided with shut-off devices (not shown) can be connected to the connection lines 11 and 12. It is also possible to use vapour as sole drying means in order to dry yarn coloured with dyes in an organic solvent and recover the solvent.

As can be seen from the drawing, the connection line 12 can be provided at 29 with a compressed air terminal, with shut-off device, in order to connect the device to an external compressed air source.

If desired, the drying process can also be carried out in just one container, in which case it is of considerably shorter duration due to the fact that the compressor is dimensioned for two containers.

The uniform flow of the drying process serves to achieve a saving both of energy and of time.

We claim:

1. A process for drying two separate units of moist fibrous material, in particular in the form of reels of yarn, comprising flowing under a pressure greater than one atmosphere in a closed circuit a gaseous medium through both units of material, such that the gaseous exhaust from one unit is the gaseous intake of said other unit, and heating the gaseous medium subsequent to its passage through the units of fibrous material by compressing the gaseous medium.

2. A process as claimed in claim 1, wherein:

the moisture content of one of the units of fibrous material is different than that of the other unit.

3. An apparatus for drying fibrous material comprising:

two containers each of which has a support for the fibrous material to be dried, the material being positioned on the support in a manner such as to divide the interior of each of said containers into an inner and an outer chamber which communicate with each other via the material;

a circulation system having a gaseous drying medium therein, said system including said containers and comprising;

a first connection line for fliudly interconnecting the two inner chambers, a second connection line for fluidly interconnecting the two outer chambers, a first means for heating the gaseous drying medium in said first connection line, a second means for heating the gaseous drying medium in said second connection line, and a water separator;

one of said first and second heating means comprises a compressor; and the suction end of said compressor is connected to said water separator.

4. An apparatus as claimed in claim 3, further comprising:

a valve means for reversing the direction of circulation of the gaseous drying medium through the containers.

5. An apparatus as claimed in claim 4, further comprising:

a four-way valve in said second connection line.

6. An apparatus as claimed in claim 5, further comprising:

valve means for fluidly disconnecting each of the containers from the remainder of said circulation system.

7. An apparatus as claimed in claim 3, further comprising:

a compressed air terminal with a shut-off device in one of said first and second connection lines.

* * * * *